US007162905B1

(12) United States Patent
Briggs

(10) Patent No.: US 7,162,905 B1
(45) Date of Patent: Jan. 16, 2007

(54) PIPE BENDING PRESSURE DIE WITH REVERSIBLE EXIT BLOCK

(75) Inventor: Edward Briggs, Goose Lake, IA (US)

(73) Assignee: McKay Acquisition, Inc., Davenport, IA (US)

( * ) Notice: Subject to any disclaimer, the term of this patent is extended or adjusted under 35 U.S.C. 154(b) by 0 days.

(21) Appl. No.: 10/907,909

(22) Filed: Apr. 20, 2005

(51) Int. Cl.
*B21D 7/04* (2006.01)

(52) U.S. Cl. ..... 72/157; 72/149

(58) Field of Classification Search ..... 72/149, 72/154, 155, 157, 310
See application file for complete search history.

(56) References Cited

U.S. PATENT DOCUMENTS 1,847,200 A * 3/1932 Vollmerhaus ..... 72/310
2,882,953 A 4/1959 Huet
2,955,638 A 10/1960 Hellwig
3,205,690 A 9/1965 Roessler, Jr.
3,279,236 A 10/1966 Lance
3,456,482 A 7/1969 Maier et al.
3,921,424 A 11/1975 Pearson
4,355,528 A 10/1982 Rothenberger
4,532,787 A 8/1985 Caporusso et al.
4,986,104 A 1/1991 Caporusso et al.
5,056,347 A * 10/1991 Wagner ..... 72/149
5,345,802 A 9/1994 Caporusso et al.
5,469,728 A 11/1995 Caporusso et al.

* cited by examiner

*Primary Examiner*—Lowell A. Larson
(74) *Attorney, Agent, or Firm*—Ryan N. Carter

(57) ABSTRACT

A pressure die having a base portion with an entrance block and an exit block attached thereto. The entrance block and exit block each have a groove adapted to receive the pipe. The curvilinear geometry of the groove of the exit block is constant so that the exit block is symmetrical and can be attached to the base portion in either a first position or a second position in which the exit block is rotated 180 degrees. The exit block is mounted onto the base portion at an angle so that the entrance portion of the exit block is lower in elevation than the exit portion of the exit block. The angle allows for a smooth transition from clearance to compression between the pipe and surface of the groove.

3 Claims, 5 Drawing Sheets

PIPE BENDING PRESSURE DIE WITH REVERSIBLE EXIT BLOCK

BACKGROUND OF THE INVENTION

This invention relates to pipe bending machines, and more particularly to a pressure die having a symmetrical and reversible exit block.

Pipe bending machines include die halves or die blocks having cavities or grooves for receiving and contacting the pipe or tubing during the bending operation (hereinafter collectively referred to as "pipe"). Typically, a pipe bending machine comprises at least two dies, a pressure die and a forming die. The pressure die applies bending pressure to the pipe around the curvature of the forming die. The forming die, pressure die, or both rotate relative to the other to achieve the required bending pressure to bend the pipe.

One problem with traditional pipe bending devices and techniques is that the round shape of the pipe deforms or flattens as the pipe is bent around the forming die. The reason for this deformation is that as the pipe is bent, the outer portion of the pipe is drawn in the direction of the bend, which flattens the outer portion of the pipe. Devices such as the ones disclosed in U.S. Pat. Nos. 5,694,800, 5,469,728, and 5,345,802 have tried to overcome the pipe deformation problem by narrowing the curvilinear geometry of the groove at the exit end of the pressure die so that the exit end of the groove is narrower than the pipe before it is bent. These patents disclose that narrowing the exit end of the pressure die groove causes high axial frictional forces allowing the pressure die to draw the pipe during bending since the narrowed end has a smaller radius than the pipe before it is bent. These patents disclose a space beneath the pipe and the groove of the pressure die so that as the pipe is being drawn, it is also being forced toward the surface of the groove, which causes the pipe to conform to the exit edge of the exit block groove (it ovals the pipe).

Another problem with many pressure dies is that they become worn out quickly due to the considerable forces placed on them by pipes during bending operations. The user must replace the pressure die when it becomes worn so that the narrowed end of the pressure die remains able to grab and draw the pipe during bending. The replacement of pressure dies can be expensive because at least a portion of the pressure die must be made of an expensive high density metal strong enough to withstand considerable force.

Therefore, there is a need for a pressure die which efficiently bends pipe with minimal pipe deformation, and has an improved life thereby reducing the frequency at which new pressure dies must be purchased by the user.

SUMMARY OF THE INVENTION

The present invention is a pressure die adapted to be used with a conventional pipe or tube bending machine. The pressure die comprises a base portion having an entrance block and an exit block mounted thereto. The exit block has a first portion which is near the exit end of the exit block, and a second portion which is adjacent to the entrance block. The entrance block and the exit block have grooves which are adapted to receive the pipe during bending operations. The curvilinear geometry of the groove in the entrance block is preferably slightly larger than the pipe to be bent. The groove in the entrance block serves to guide the pipe so that it is in proper alignment with the exit block. The curvilinear geometry of the groove in the exit block is constant with respect to both size and location throughout the length of the exit block. The curvilinear geometry of the groove in the exit block is such that if the pipe to be bent is un-forcibly set in the groove of the exit block, there would be a gap between the pipe and the bottom of the exit block groove.

The exit block is mounted onto the base portion at a predetermined angle so that the exit block first portion is higher in elevation than the exit block second portion as the base portion sits on a flat surface. The exit block is mounted at an angle so as to obtain clearance between the portion of the pipe being bent (near the exit block first portion) and the portion of the pipe not yet bent (near the exit block second portion). During the bending operation, the angled exit block provides a smooth transition from clearance to compression on the pipe outside diameter (OD). The transition is obtained along the length of the exit block between the exit block second portion, where there is complete clearance between the pipe and the walls and bottom of the exit block, and the exit block first portion, where the pipe is forced toward the surface of the exit block groove during the bending operation.

The entrance block and exit block are removably combined with the base portion by any suitable means. The exit block is symmetrical so that it is capable of being removed from the base portion, rotated one-hundred-eighty degrees, and then reattached to the base portion. The exit block is symmetrical because the curvilinear geometry of the groove in the exit block is constant throughout the exit block's length. Under normal bending operations, only the first portion of the exit block acts on and draws the pipe being bent. Therefore, the symmetrical exit block provides a significant advantage over the above discussed prior art because when the exit block first portion becomes worn due to friction and force with pipe, the exit block can be removed, rotated, and reattached so that the worn first portion of the exit block is positioned at the exit block second portion, which typically does not contact the pipe with a high amount of friction. The ability to reverse the position of the exit block because of its constant curvilinear geometry effectively doubles the usable life of the exit block.

DESCRIPTION OF THE PREFERRED EMBODIMENT OF THE INVENTION

Figure 1:
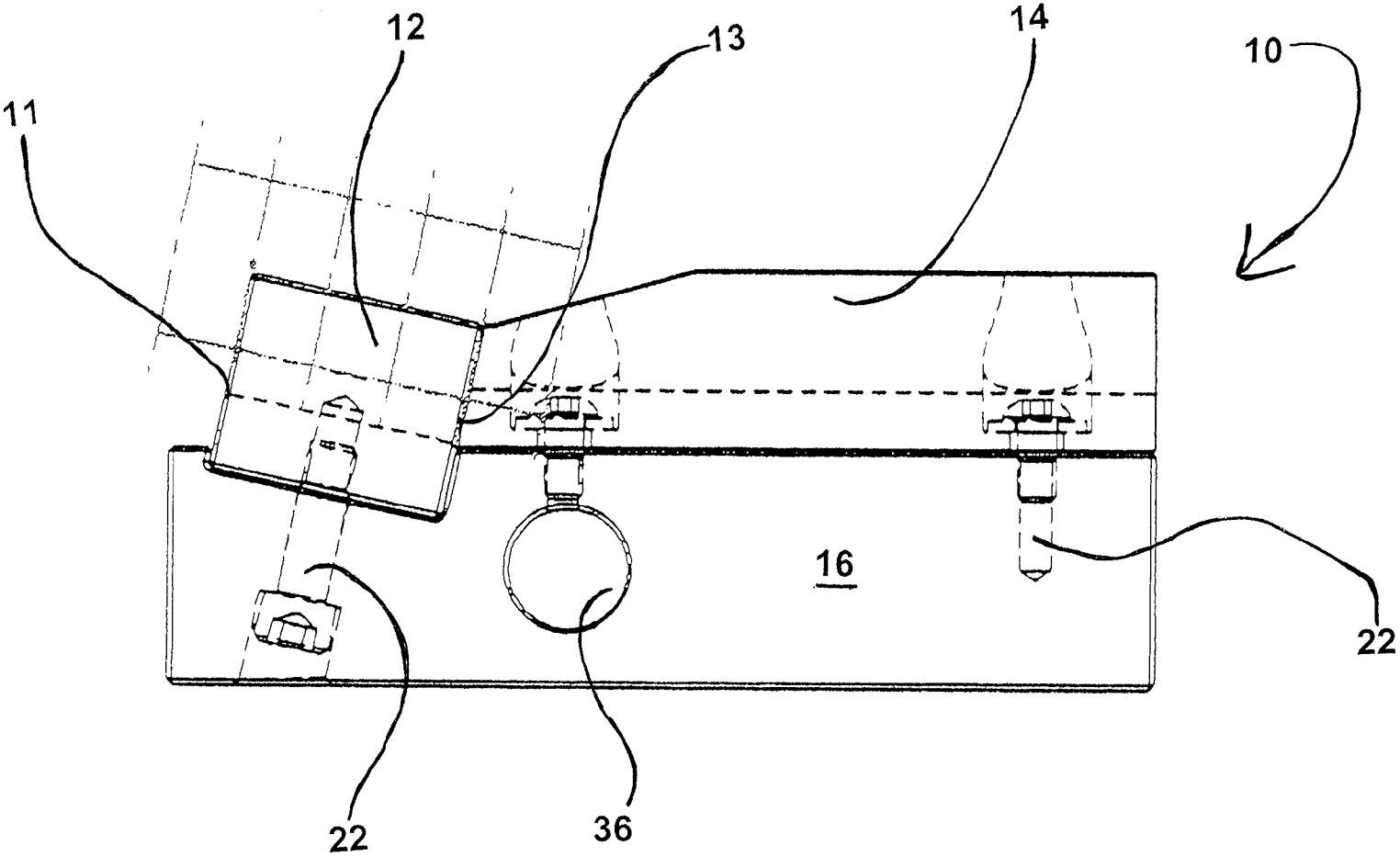
FIG. 1 is an elevation view of the pressure die showing the angled exit block.
Figure 2:
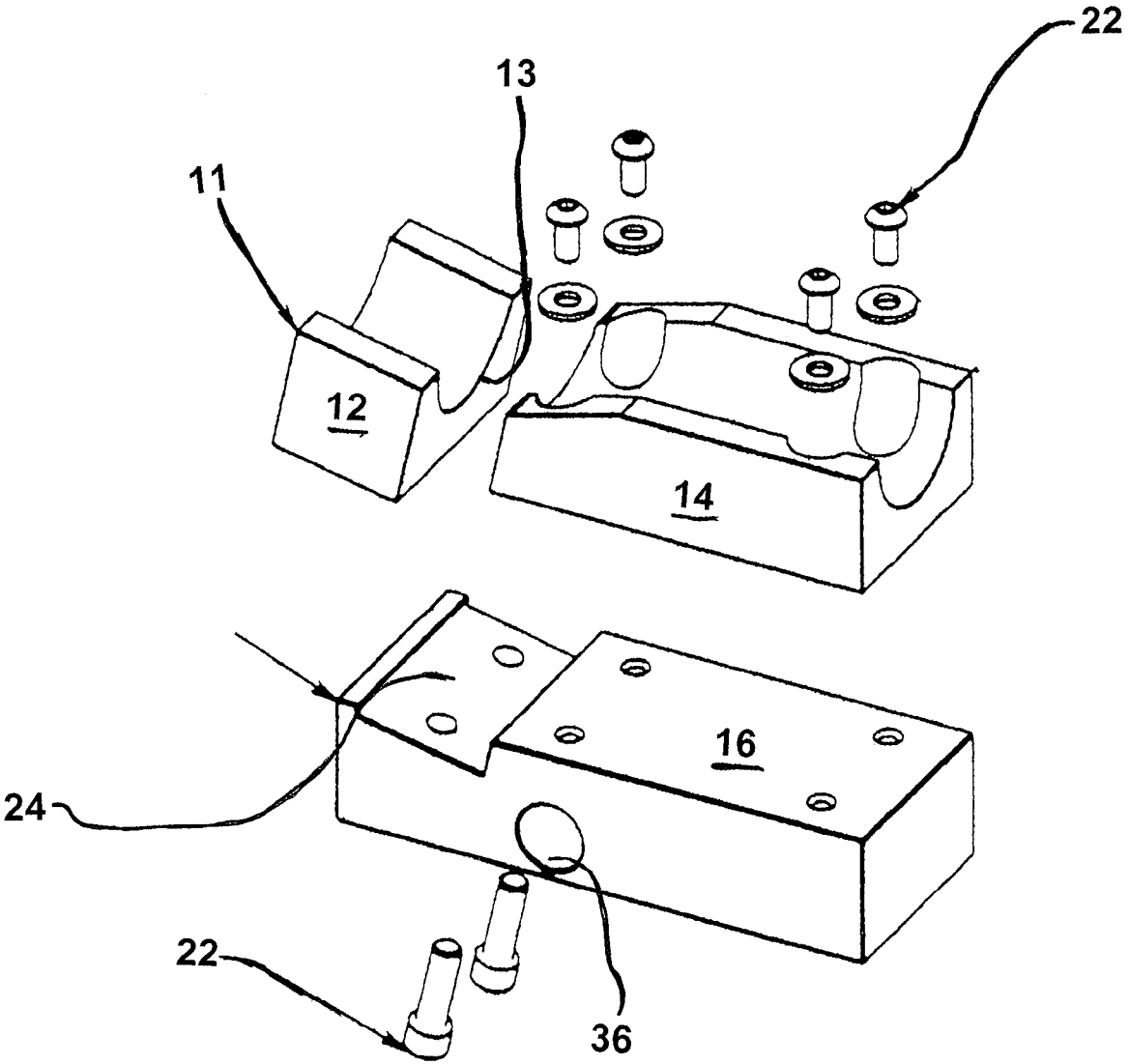
FIG. 2 is an exploded view of the pressure die showing the entrance block and exit block separated from the base portion.
Figure 3:
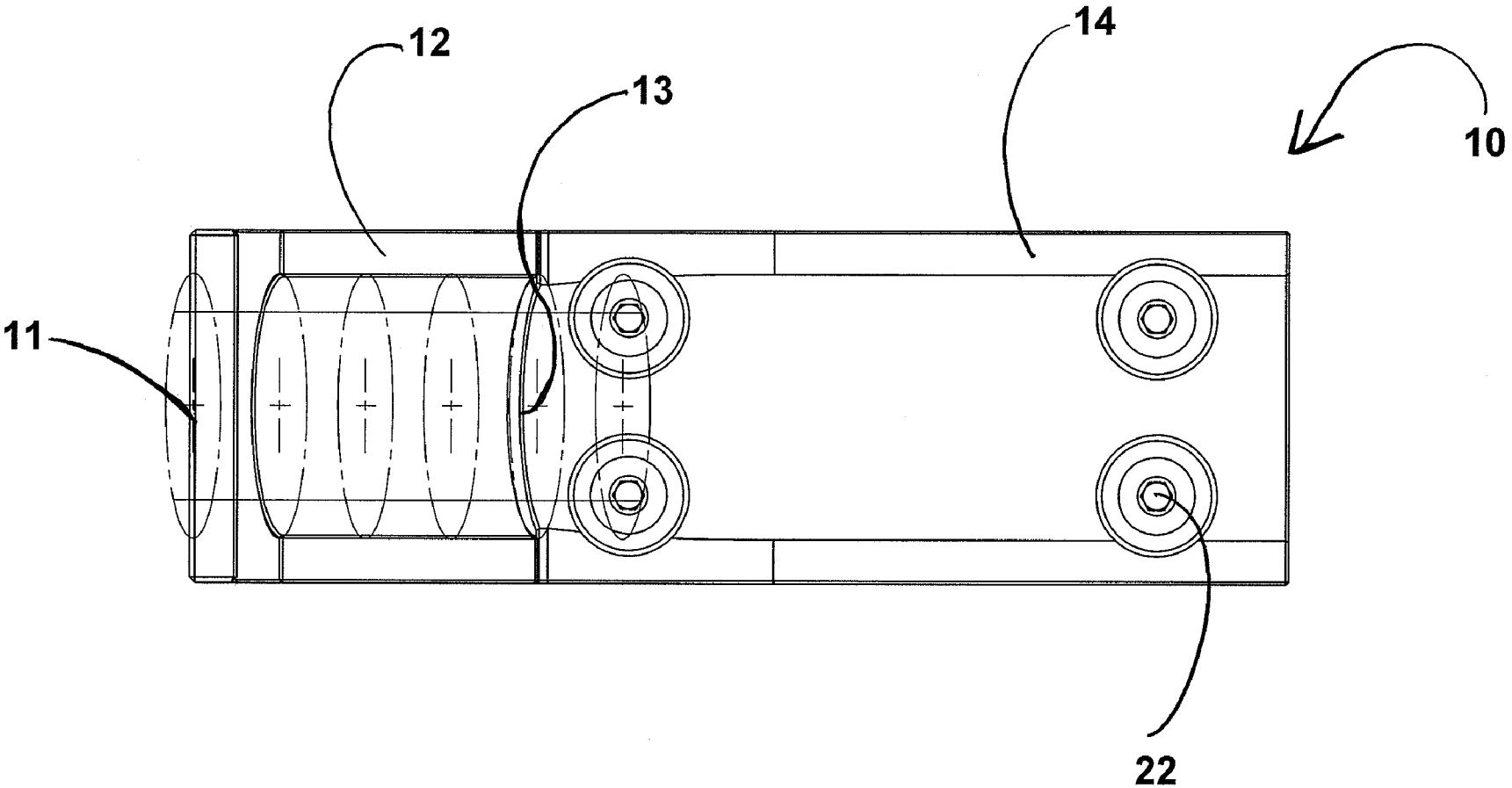
FIG. 3 is a top view of the pressure die with phantom lines showing the constant curvilinear geometry of the exit block.
Figure 4:
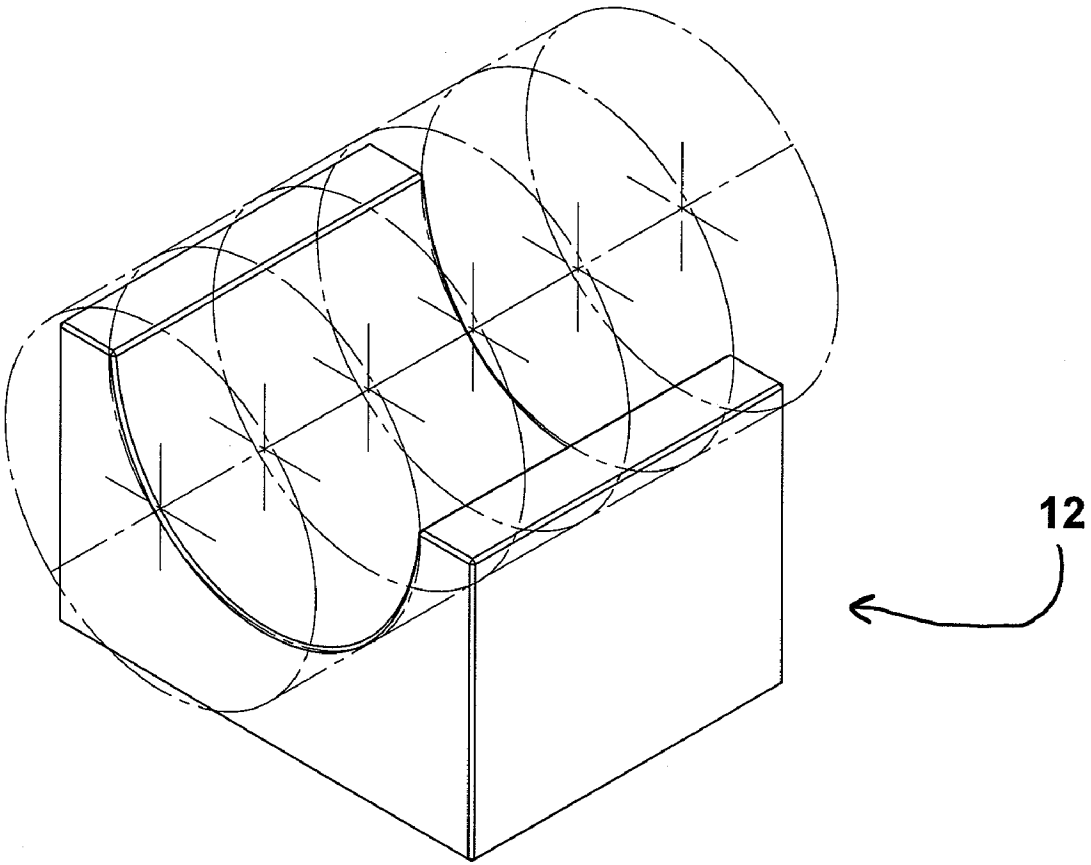
FIG. 4 is a perspective view of the exit block with phantom lines showing its constant curvilinear geometry.
Figure 5:
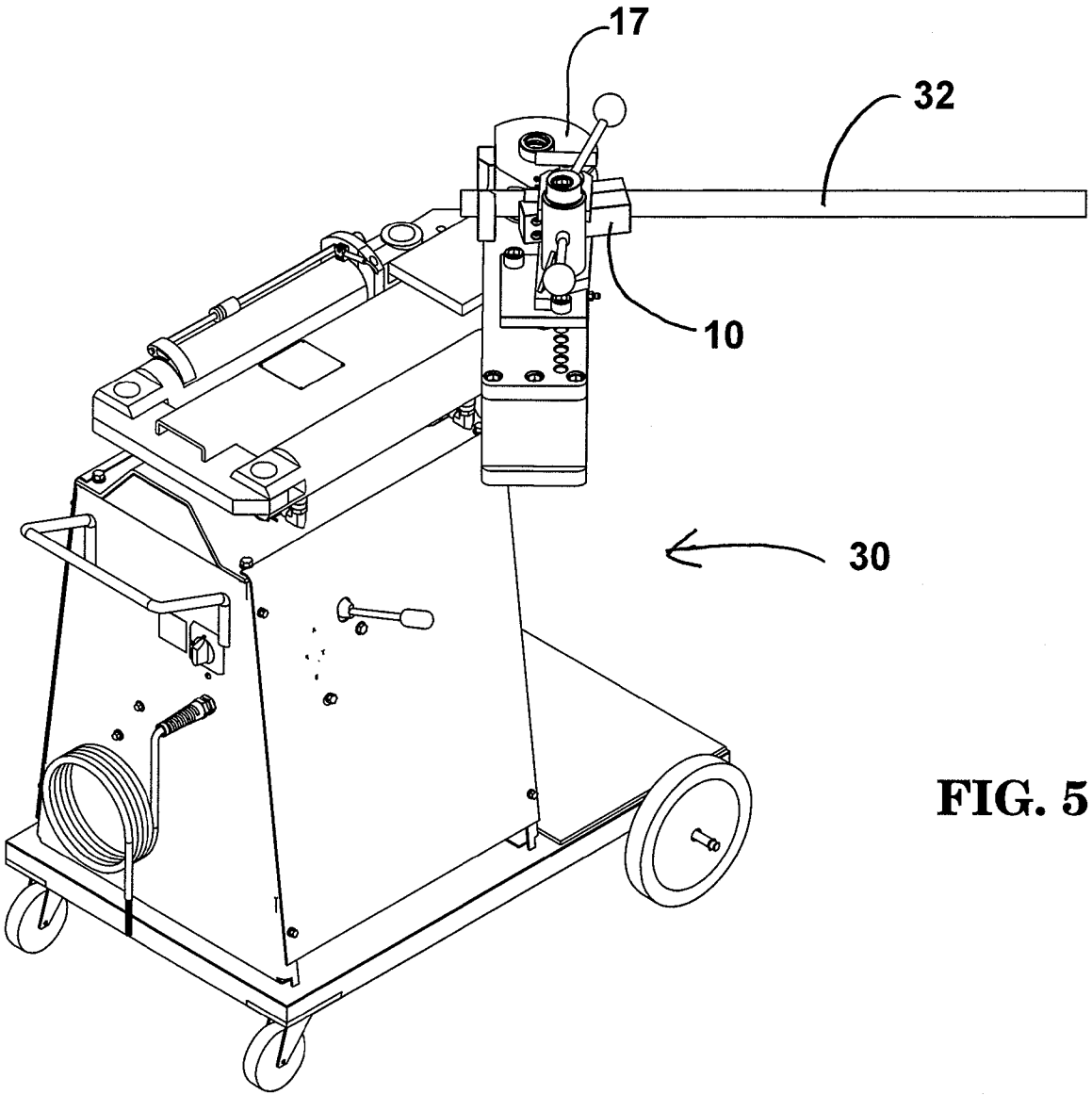
FIG. 5 is a perspective view of the pressure die of the present invention combined with a conventional pipe bending machine.

The present invention is a pressure die 10 adapted to be used with a conventional tube or pipe bending machine 30, as shown in FIG. 5. As shown in FIGS. 1 and 2, the pressure die 10 comprises a base portion 16 having an entrance block 14 and an exit block 12 combined therewith. The base portion 16 has a pivot hole 36 which is adapted to receive a rod for combining the pressure die 10 to the bending machine 30. The exit block 12 has a first portion 11 which is near the exit end of the exit block 12, and a second portion 13 which is adjacent to the entrance block 14. The entrance block 14 and the exit block 12 have grooves which are adapted to receive the pipe 32 during bending operations. The curvilinear geometry of the groove in the entrance block 14 is preferably slightly larger than the pipe 32 to be bent. The groove in the entrance block 14 serves to guide the pipe 32 so that it is in proper alignment as it moves into the exit block 12. As shown by the phantom lines in FIGS. 3 and 4, the geometry of the curvature in the exit block 12 is constant throughout the length of the exit block 12. The curvilinear geometry of the exit block 12 is such that if you un-forcibly set the pipe 32 to be bent in the exit block 12, there would be a gap between the pipe 32 and the floor (bottom) of the exit block 12 groove.

As shown in FIGS. 1 and 2, the exit block 12 is mounted onto the base portion 16 at a predetermined angle so that the exit block first portion 11 is higher in elevation than the exit block second portion 13. In use, the majority of the drawing force is applied to the pipe 32 near the exit block first portion 11, with the drawing force diminishing in the direction of the exit block second portion 13. Bending pressure is developed along the length of the entrance block 14 at the line of contact between the pipe 32 and the forming die 17, where the pipe 32 is being bent. Bending pressure is caused by the forming die 17 and pressure die 10 moving relative to each other, with the pipe 32 inserted between the forming die 17 and the pressure die 10. The majority of the bending pressure acts on the entrance portion of the entrance block 14. The bending pressure proportionally causes the exit block 12 to be in forcible contact with pipe 32, thereby creating some degree of deformation of the pipe 32 and creating friction between the exit block 12 and the pipe 32. The friction causes the pipe 32 to be drawn by the exit block first portion 11 as the pipe 32 moves linearly relative to the pressure die 10.

In addition to linear elongation, the forcible contact causes the pipe 32 to flow toward and conform with the curvilinear geometry of the exit block 12 groove, i.e. the forcible contact induces drawing action combined with deformation which ovals the pipe 32 as it conforms to the exit edge 11 of the exit block 12. The angled mounting of the exit block 12 provides a smooth transition along the length of the exit block 12 between the exit block second portion 13, where there is complete clearance between the pipe 32 and the curvilinear geometry of the exit block 12 groove, and the exit block first portion 11, where the pipe 32 is forced and drawn toward the floor (bottom) and walls of the exit block 12 groove during the bending operation.

In the preferred embodiment, the entrance block 14 and exit block 12 are removably combined with the base portion 16 by any suitable means, however, in an alternate embodiment, the base portion 16 may be permanently combined with the entrance block 14 and/or the exit block 12. In the preferred embodiment, the blocks 12, 14 are combined with the base portion 16 by bolts 22, as best shown in FIG. 2. The exit block 12 is capable of being removed, rotated, and reattached to the base portion 16 so that the exit block first portion 11 is repositioned to become the exit block second portion 13. This is possible because the curvilinear geometry of the exit block 12 is constant through the length of the groove, i.e. the curvilinear geometry of the exit block 12 groove is symmetrical. When the exit block first portion 11 becomes worn due to its forcible contact with pipe 32, the exit block 12 can be removed, rotated, and reattached to the base portion 16 so that the worn portion of the exit block 12 is positioned adjacent to the entrance block 14. As discussed above, the portion of the exit block 12 near the entrance block 14 does not engage the pipe 32 with the same high level of friction as does the exit block first portion 11. In addition, when both ends of the exit block 12 become worn, the exit block 12 can be replaced without having to replace the entire pressure die assembly 10, i.e. without having to replace the mounting block 16 and the entrance block 14.

In use, the pipe 32 is loaded into the bending machine 30, which is powered by any suitable means, which may include hydraulics. The pressure die 10 is positioned so that as the forming die 17 and/or pressure die 10 are actuated, the majority of the forcible contact occurs at the exit block first portion 11. As the pipe 32 is moved through the pressure die 10, the pressure on the pipe 32 pushes the pipe 32 toward the surface of the groove of the exit block 10. The curvilinear geometry of the groove of the exit block 12 is smaller than the pipe 32 being bent so that friction is created between the pipe 32 and the pressure die 10 near the pressure die first end 11. As the pipe 32 continues to move through the pressure die 10, the friction causes the pipe 32 to be drawn or pulled through the bend. As the pipe 32 is drawn through the bend, bending pressure causes the pipe 32 to be forced toward the surface of the groove near the exit block first portion 11, which causes the pipe 32 to conform to the exit edge 11 of the exit block 12 groove (it ovals the pipe 32).

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

What is claimed is:

1. A pressure die adapted for attachment to a pipe bending machine which is adapted to bend a pipe, said pressure die comprising:

a base portion;

an entrance block portion combined with the base portion, said entrance block having a longitudinal groove adapted to receive the pipe; and an exit block portion removably combined with the base portion adjacent to the entrance block, said exit block having a longitudinal groove adjacent to the longitudinal groove of the entrance block and adapted to receive the pipe;

the groove in the exit block having a constant curvilinear geometry.

2. A pressure die adapted for attachment to a pipe bending machine which is adapted to bend a pipe, said pressure die comprising:

a base portion;

an entrance block portion combined with the base portion, said entrance block having a longitudinal groove adapted to receive the pipe; and an exit block portion combined with the base portion adjacent to the entrance block, said exit block having a longitudinal groove adjacent to the longitudinal groove of the entrance block and adapted to receive the pipe, wherein the exit block comprises a first portion and a second portion, and wherein the exit block is combined with the base portion at an angle so that the exit block first portion is higher in elevation than the exit block second portion;

the groove in the exit block having a constant curvilinear geometry.

3. A pressure die adapted for attachment to a pipe bending machine which is adapted to bend a pipe, said pressure die comprising:

a base portion;

an entrance block portion combined with the base portion, said entrance block having a longitudinal groove adapted to receive the pipe; and an exit block portion combined with the base portion adjacent to the entrance block, said exit block having a longitudinal groove adjacent to the longitudinal groove of the entrance block and adapted to receive the pipe;

the groove in the exit block having a constant curvilinear geometry;

wherein the curvilinear geometry of the groove in the exit block causes slight interference with the pipe to be bent.

* * * * *